US007533614B1

(12) United States Patent
Reich

(10) Patent No.: US 7,533,614 B1
(45) Date of Patent: May 19, 2009

(54) MEMORY ENHANCED AMMUNITION CARTRIDGE AND METHOD OF MAKING AND USING THE SAME

(76) Inventor: Ronald E. Reich, 46 Presidio Ave., San Francisco, CA (US) 94115

( * ) Notice: Subject to any disclaimer, the term of this patent is extended or adjusted under 35 U.S.C. 154(b) by 114 days.

(21) Appl. No.: 11/227,344

(22) Filed: Sep. 8, 2005

(51) Int. Cl.
*F42B 5/02* (2006.01)
*F42B 30/02* (2006.01)

(52) U.S. Cl. ..... 102/430

(58) Field of Classification Search ..... 102/430, 102/473, 501, 517
See application file for complete search history.

(56) References Cited

U.S. PATENT DOCUMENTS

| | | | | |
|---|---|---|---|---|
| 4,150,624 | A * | 4/1979 | Hammond | 102/293 |
| 4,924,078 | A * | 5/1990 | Sant'Anselmo et al. | 235/494 |
| 5,646,365 | A | 7/1997 | Collier | |
| 5,698,816 | A * | 12/1997 | Roxby | 102/516 |
| 6,209,459 | B1 | 4/2001 | Kaufman et al. | |
| 6,247,411 | B1 * | 6/2001 | Vornfett | 102/472 |
| 6,247,412 | B1 * | 6/2001 | Vornfett | 102/472 |
| 6,283,034 | B1 * | 9/2001 | Miles, Jr. | 102/430 |
| 6,293,204 | B1 * | 9/2001 | Regen | 102/430 |
| 6,422,507 | B1 * | 7/2002 | Lipeles | 244/3.13 |
| 6,462,302 | B1 | 10/2002 | Grow | |
| 6,810,816 | B2 | 11/2004 | Rennard | |
| 6,833,911 | B2 | 12/2004 | Lizotte | |
| 6,886,284 | B2 | 5/2005 | Lizotte | |
| 2002/0178959 | A1 | 12/2002 | Rennard | |
| 2003/0097776 | A1 | 5/2003 | Broscow | |
| 2004/0049965 | A1 | 3/2004 | Breiner | |
| 2004/0200108 | A1 | 10/2004 | Doiron | |
| 2005/0005806 | A1 | 1/2005 | Mace et al. | |
| 2005/0045056 | A1 | 3/2005 | Ekenedilichukwo | |
| 2005/0170784 | A1 | 8/2005 | Ariyoshi et al. | |
| 2005/0174845 | A1 | 8/2005 | Koyama et al. | |
| 2005/0185460 | A1 | 8/2005 | Roesner et al. | |

* cited by examiner

*Primary Examiner*—Bret Hayes
(74) *Attorney, Agent, or Firm*—Pillsbury Winthrop Shaw Pittman LLP

(57) ABSTRACT

The present invention provides a memory enhanced ammunition cartridge. The memory enhanced cartridge can be manufactured using a conventional bulk processing methodology. The bullet of the cartridge contains therein a memory within it. This memory can be programmed with the retail purchaser identification at the point of sale, thereby avoiding the need for a database of information relating to purchasers of ammunition. After the cartridge has been used, the ejected bullet can be located at the target, and the memory read to determine the identity of the purchaser, and potentially the user, of the bullet.

37 Claims, 4 Drawing Sheets

MEMORY ENHANCED AMMUNITION CARTRIDGE AND METHOD OF MAKING AND USING THE SAME

FIELD OF THE INVENTION

The present invention relates to an identification device and methods of making and using the same, and, more particularly, an identification device that includes a memory and is usable for tracking an ammunition cartridge, specifically a bullet, and methods of making and using the same.

BACKGROUND OF THE INVENTION

Identification devices and methods of making and using the same are well known. In particular, devices for identifying retail purchasers of ammunition cartridges, including bullets within them, are also known. Conventionally, an ammunition identification device uses a physically readable mark as an identifier, which mark is placed either directly on the bullet, on a casing of a bullet, or on a barrel of a gun.

In the case of the marking the casing, the identifier remains with the casing when the ammunition cartridge is shot. In the case of marking either the bullet directly at time of manufacture, or indirectly when marking the barrel, such that when the bullet is shot through the barrel, the identifier on the barrel becomes imprinted on the bullet, the identifier remains with the bullet. Examples of these different types of ammunition tracking devices abound, with representative such devices being disclosed in U.S. Pat. Nos. 6,293,204; 6,462,302; and 6,886,284.

While conventional ammunition identification devices have a degree of usefulness, they also have their limitations. One significant limitation is that the identifier must be placed on either the ammunition cartridge or the gun barrel at the time of manufacture. This limitation has a number of negative consequences. One is that in order to associate an identity with the identifier, a database that is linked to all areas where the ammunition and/or guns with marked barrels are sold is required to provide an index between identity of the individual who has purchased the ammunition cartridge or the gun, and the identifier. Such a database is both difficult to manage, and also raises privacy concerns. Another negative consequence is that additional identifier information cannot be added after the manufacture of the ammunition and/or gun. Another limitation is that it is more difficult to effectively manage distinct identifiers, as they are constrained by the physical limitations of the bullet surface on which marking can occur. Still another significant limitation is that by applying different marks to ammunition cartridges requires changing the manner in which such ammunition cartridges are made from a bulk manufacturing process, in which all ammunition cartridges are made the same way, to a batch manufacturing process, in which different batches of ammunition cartridges are made (such as divided by the box size of the ammunition cartridge), in order apply a different identifier to all the ammunition cartridges in a single box.

In view of the above limitations, and others, a new identification device is needed, that is usable for identifying the retail purchaser of an ammunition cartridge, specifically a bullet, and methods of making and using the same.

SUMMARY OF THE INVENTION

The present invention is directed to an identification device, and a method of making and using the same.

In a particular embodiment, the identification device is a memory enhanced ammunition cartridge. The memory enhanced cartridge can be manufactured using a conventional bulk processing methodology. The bullet of the cartridge contains therein a memory device within it. This memory device can be programmed with the retail purchaser identification at the point of sale, thereby avoiding the need for a database of information relating to purchasers of ammunition. After the cartridge has been used, the ejected bullet can be located at the target, and the memory read to determine the identity of the purchaser, and potentially the user, of the bullet.

Methods of manufacture and using the memory enhanced ammunition cartridge are also described.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION OF THE PREFERRED EMBODIMENTS

The present invention is directed to an identification device and a method of making and using the same. The preferred embodiment of the identification device, as described, is for usage in an ammunition cartridge. It will be apparent; however, that there are aspects of the present invention that can be applied for use in identifying retail purchasers of devices other ammunition cartridges, and as such this detailed description should be so interpreted.

It is also noted, however, that an aspect of the preferred embodiment of the present invention is that the identification device is solely for the purpose of associating the identity of an associated retail purchaser, without having other components, and as such is distinguished from identification devices that are within and part of much larger systems.

Figure 1:
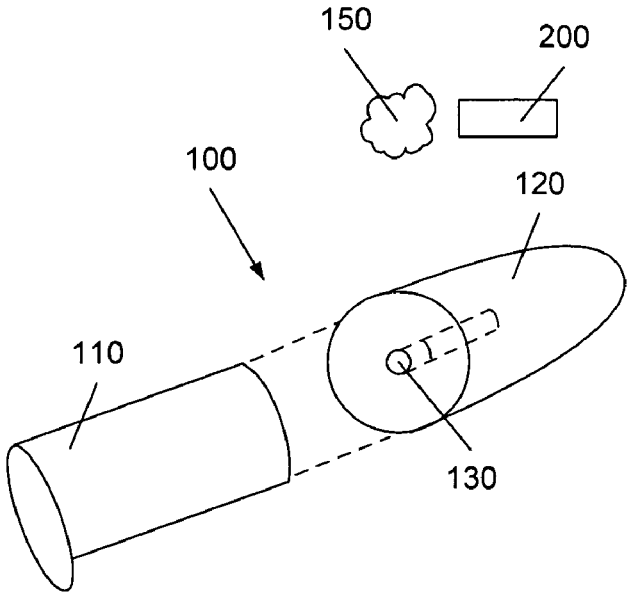
FIG. 1 illustrates an exploded view of the components of a memory enhanced ammunition cartridge according to the present invention.

FIG. 1 illustrates an exploded view of the components of a memory enhanced ammunition cartridge 100 according to the present invention. As illustrated the cartridge 100 includes a casing 110 and a bullet 120 in which, as is known, the casing 110 remains with the weapon at shooting, and the bullet 120 becomes the projectile. Not shown are the primer and explosive which are inserted into the casing 110. Also illustrated is a hole 130 that is drilled into the bullet 120. Illustrated separately are a memory device 200, and a plug 150.

The cartridge 100 is conventional, and can be for use in any size of a weapon, though the preferred embodiment is specifically directed to ammunition used in personal firearms, whether handguns or longguns.

It is also noted that the present invention in its preferable form does not require any type of database to be maintained, as the identification information on the bullet that is stored on the memory enhanced ammunition cartridge 100 is private to the retail purchaser. As such, that privacy is maintained at the point of purchase. Alternative embodiments are envisioned, however, in which a database could be maintained, or a database that keeps information on the purchases from certain types of individuals, certain classes of persons (such as excluded groups referenced hereinafter) or for certain classes of firearms—memory enhanced ammunition cartridges 100 for semiautomatic weapons for instance.

The bullet 120 is also of essentially conventional manufacture, other than the alterations described herein which is essentially that it has the hole 130 drilled or originally formed in it, which allows for insertion of the memory device 200 therein, which is then held in place with a combination of tension forces as well as the plug 150. With respect to the size of the hole 130, this size is primarily dictated by the size of the memory device 200, and secondarily dictated by the caliber of the bullet. The larger the bullet 120, the easier it is to make a larger hole 130, and have a physically larger sized memory device 200 inserted therein, which, due its larger size, can also hold additional optional components, as will be described herein.

It should also be noted that testing may need to be done on the bullet 120 having a hole 130 placed therein, as the weight distribution of the bullet 120 changes as a result of the void caused by the hole 130, which can effect the accuracy of the bullet 120 after it escapes from the barrel of the gun from which it was fired.

The plug 150 is made of a material that will hold the memory device 200 into the hole 130, and many different kinds of materials can be used and are contemplated, though in certain embodiments it may not be necessary to use anything other than friction forces between the memory device 200 and the wall of the hole 130 formed in bullet 120. It has been determined that clay is an appropriate material for plug 150. Although epoxy and other glues can also be used, as a result of setting up after drying to be more stiff, they allow for greater force to be transferred to the memory device 200 upon impact of the bullet 200 with the target. As such, with more force transferred, there is a greater likelihood that the memory device 200 may malfunction due to breakage. Further, it is also possible to use a flexible conductor as the plug 150, which can also be configured for use as the antenna described hereinafter.

Figure 2:
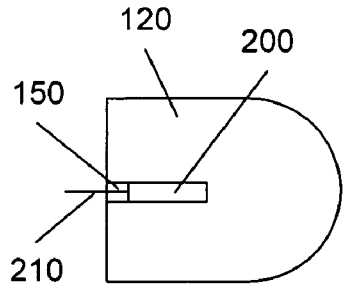
FIG. 2 illustrates an enlarged view of the bullet illustrated in FIG. 1 and containing a memory device according to the present invention.

FIG. 2 illustrates an enlarged view of a bullet 120 illustrated in FIG. 1 and containing a memory device 200 within the drilled hole (not labeled here), which is then kept in position with plug 150. Associated with the memory device 200 is an antenna 210, which as illustrated projects out of the bullet, thereby making the reception of the antenna 210 greater. Although shown in this and other drawings as a single antenna, the antenna 210 could have multiple antennas for even greater reception capabilities, or have one antenna for transmit and another for receive operations, as discussed herein. Furthermore, in certain embodiments, the antenna may not need to project out of the hole 130, or even project off of the memory device 200, but instead be made integral with it.

Figure 3:
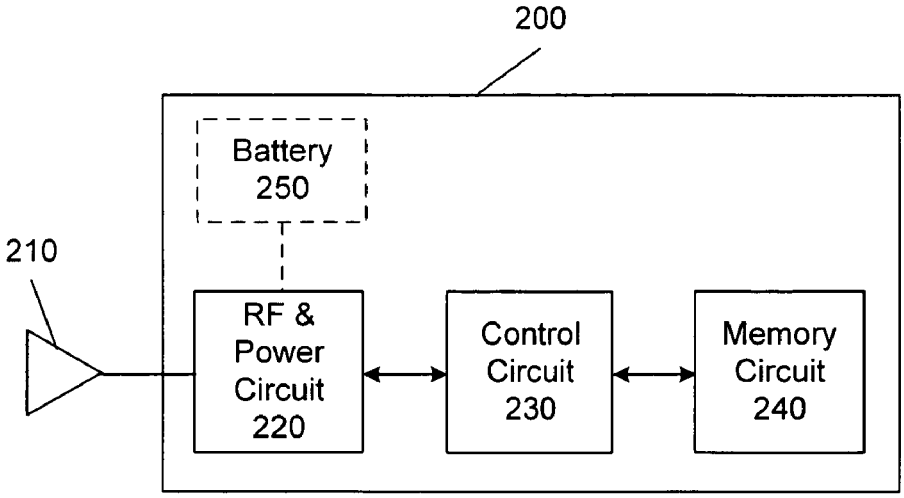
FIG. 3 illustrates one embodiment of a memory device according to the present invention.

FIG. 3 illustrates one embodiment of the memory device 200. Components of the memory device 200 include an RF and power circuit 220, a control circuit 230, and a memory circuit 240. The memory circuit 240 is preferably a one-time only write EEPROM or other similar device, though the present invention should not be limited to any specific type of memory store. The control circuit 230 controls the programming of the memory device, as well as the subsequent reading operations. RF and power circuit 220 is used during both programming and reading operations, primarily to receive the signal or signals (depending upon whether the same signal is used to transmit data as is used to transmit power) externally transmitted from programming devices or reading devices, as will be described hereinafter. A specific detailed example of circuit that can be used to produce the memory device 200 is illustrated and described, particularly with reference to the FIG. 2 and related drawings and disclosure therein, in Published U.S. Patent Application No. US2005/0174845 and entitled "Semiconductor Device," which application is expressly incorporated by reference herein.

The above description of memory device 200 is predicated on the power being externally supplied through an RF signal. For larger capacity memories, or for memory devices that use less power efficient circuits, in an alternate embodiment, provision can also be made to include an on-board battery, which will typically only be used one time, during the programming operations. This battery can be triggered upon the receipt of a predetermined data sequence recognized by a comparison circuit that is part of either the RF and power circuit 220 or the control circuit 230.

Figure 4:
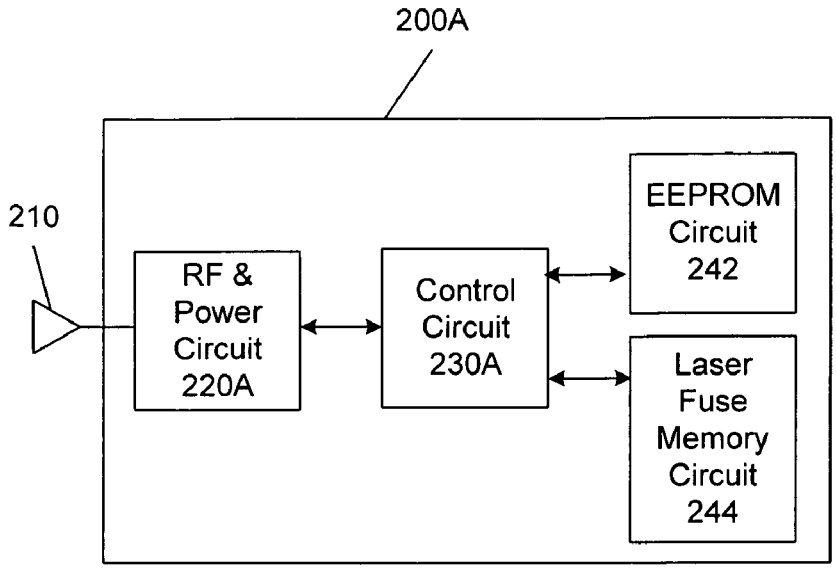
FIG. 4 illustrates another embodiment of a memory device according to the present invention.

FIG. 4 illustrates another embodiment, illustrated as memory device 200A. In contrast to the embodiment described by FIG. 4, this embodiment illustrates two different types of memory arrays being used: an EEPROM circuit 242 and a laser fuse memory circuit 244. The laser fuse memory circuit can be laser fused prior to installation of the memory device into the bullet 120, and contain information that will be the same for all bullets 120, such as an identification of the manufacturer, and the manufacturing date. Having an embodiment such as this is advantageous in that certain information can be programmed prior to installation of the device, thus avoiding the need to use electrical power that is either transmitted through an RF signal or stored in an on-board battery when subsequently programming other information thereon.

Figure 5:
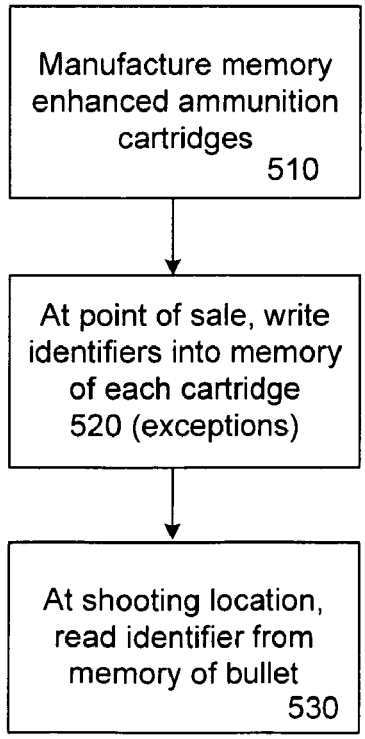
FIG. 5 illustrates a flowchart of the overall life cycle of the process flow of a memory enhanced ammunition cartridge according to the present invention.

FIG. 5 illustrates a flowchart of the overall life cycle of the process flow of a memory enhanced ammunition cartridge 100 according to the present invention. As illustrated, there are three distinct timeframes of interest. The first, illustrated as step 510, is the manufacture of memory enhanced ammunition cartridges. The manufacturing sequence, which continues to allow for the use of bulk rather than batch manufacturing methods, is described further hereinafter with reference to FIG. 6.

Figure 7:
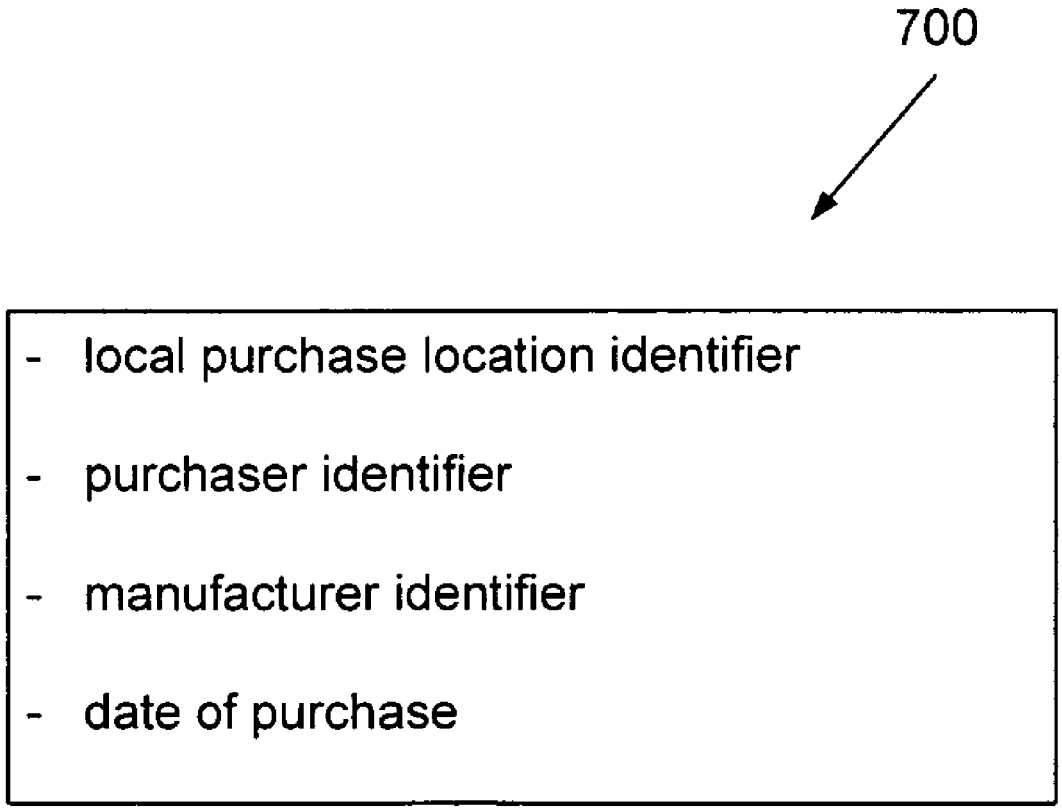
FIG. 7 illustrates various identifiers for programming into the memory of the memory enhanced ammunition cartridge according to the present invention.

Step 520 is the next significant timeframe of interest, which is at the point of sale. At the point of sale, a buyer must show identification in order to purchase memory enhanced ammunition cartridges 100, which are typically sold in boxes of so many units, such as 20-100 or more. At the point of sale, a programming device is used to program each of the memory enhanced ammunition cartridges 100 in a box with the same information. The information that is required is typically at least the identity or the driver's license or the firearms license number of the buyer. Other types of identification information that can be stored, depending upon the memory capacity, are illustrated in Fig. the identifier table 700 of FIG. 7. Exceptions to the programming operation are also preferably allowed when the memory enhanced ammunition cartridges 100 are being purchased by a predetermined class of individuals, such as police officers, military personnel, or other identified excluded groups. When an individual from an excluded group makes a purchase, however, a special code can be inserted, if desired, that at least identifies the excluded group to which the individual belongs. The programming device that is used can be conventional, made to specifications that correspond to the particulars of the specific type of memory and associated circuits used within the memory device 200. While it is contemplated that the memory enhanced ammunition cartridges 100 can remain within the box in which they are sold, in certain circumstances it may be necessary to remove the memory enhanced ammunition cartridges 100 from the box, in order to have an automatic aligner align the memory enhanced ammunition cartridges 100, and thereby align the antennas 210 within each of them, in order to ensure that each is programmed correctly.

At the point of sale, there can also be a test step that is optionally performed to ensure that proper programming has occurred.

Step 530 is the last significant timeframe of interest, which occurs after the memory enhanced ammunition cartridge 100 has been fired, and has lodged in the target of interest. Due to the construction and location of the memory device 200 at the back of the bullet, it has been determined that in most instances, the memory device 200 will remain intact. When discovered, a conventional reading device can automatically read the previously stored identifier information from the memory device 200 disposed within the bullet 120. This can then allow for rapid detection, if needed, of the person most likely to have fired the bullet.

Figure 6:
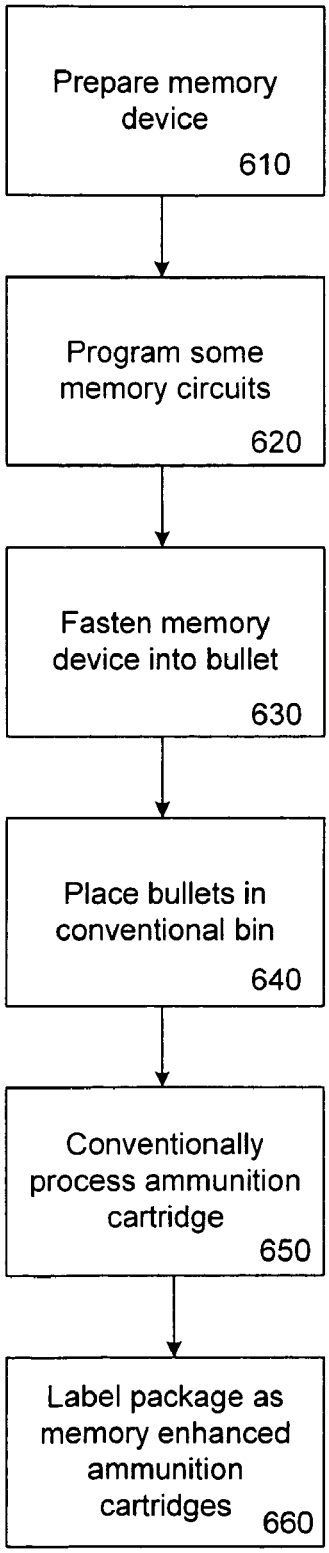
FIG. 6 illustrates a flowchart of the manufacturing process of the memory enhanced ammunition cartridge according to the present invention.

FIG. 6 illustrates a flowchart of the manufacturing process of the memory enhanced ammunition cartridge 100 according to the present invention. As illustrated, in step 610, the memory device 200 is prepared. Thereafter, in optional step 620, there can be performed any preprogramming such as that associated with the laser fuse described previously in FIG. 4, or other type of preprogrammed memory devices. This preparation will typically be bulk manufacturing, so that the quantity of memory devices made equals the typical capacity of the ammunition manufacturing facility.

Step 630 then follows, in which each memory device 200 is placed into one bullet 120, a and then preferably maintained in position using the plug 150, as has been described previously. Thereafter, step 640 follows and all the bullets 150 with the memory devices 200 disposed therein are placed in a bin for subsequent bulk manufacture, which then occurs at step 650. Once the memory enhanced ammunition cartridge 100 is manufactured, it is placed in a box that is appropriately labeled with a manufacturers label that describes the type of memory enhanced ammunition cartridge, and may include thereon information for scanning identifier information that can be read from the programming device and then used to input into the memory device 200, as illustrated in step 660. Once so placed, the boxes of memory enhanced ammunition cartridges 100 can be distributed to retail outlets as conventionally done, and then, once sold, further programmed as previously described.

It is apparent that the above embodiments may be altered in many ways without departing from the scope of the invention. For example, could also apply the memory device described herein the casing of memory enhanced ammunition cartridges. Further, various aspects of a particular embodiment may contain patentably subject matter without regard to other aspects of the same embodiment. Still further, various aspects of different embodiments can be combined together. Accordingly, the scope of the invention should be interpreted in a manner consistent with these principles and in light of the following claims.

I claim:

1. An apparatus fired by a gun and capable of having an identifier associated therewith written to with a programming device and read therefrom with a reading device, the apparatus comprising:

a casing having an open end;

explosive material disposed within the casing;

a bullet having a front projectile end and another end that covers the open end of the casing; and a memory device attached to the bullet, the memory device having memory cells that are programmable and adapted to store in the memory cells the identifier;

wherein the memory device further includes a receiver that inputs external wireless signals and a control circuit, the control circuit adapted to input the external wireless signals and program the memory cells with the identifier that is transmitted with the external wireless signals.

2. The apparatus according to claim 1, wherein the memory device further includes a power circuit that inputs external wireless power signals.

3. The apparatus according to claim 2 wherein the memory device further includes a battery.

4. The apparatus according to claim 2 wherein the memory cells are write once only EEPROM memory cells.

5. The apparatus according to claim 4 further including laser programmable memory cells.

6. The apparatus according to claim 1 further including a hole disposed in the bullet, and the memory device is attached to the bullet by being located within the hole.

7. The apparatus according to claim 6 wherein the hole is located at the another end of the bullet.

8. The apparatus according to claim 7 further including a plug that assists in retaining the memory device within the hole.

9. The apparatus according to claim 8 wherein the plug is clay.

10. The apparatus according to claim 6 wherein the memory device includes an antenna.

11. The apparatus according to claim 10 wherein a part of the antenna projects outside of the bullet.

12. The apparatus according to claim 1 wherein the memory cells are electrically programmable memory cells.

13. The apparatus according to claim 12 further including preprogrammed memory cells.

14. The apparatus according to claim 12 further including a hole disposed in the bullet, and the memory device is attached to the bullet by being located within the hole.

15. The apparatus according to claim 12 wherein the memory device includes an antenna.

16. The apparatus according to claim 1 further including preprogrammed memory cells.

17. The apparatus according to claim 16 wherein the preprogrammed memory cells are laser programmable memory cells.

18. An apparatus fired by a gun and capable of having an identifier associated therewith written to with a programming device and read therefrom with a reading device, the apparatus comprising:

a casing having an open end;

explosive material disposed within the casing;

a bullet having a front projectile end and another end that covers the open end of the casing; and a memory device attached to the bullet, the memory device having memory cells that are programmable and adapted to store in the memory cells the identifier, wherein the memory cells are write once only EEPROM memory cells.

19. The apparatus according to claim 18, wherein the memory device further includes a receiver that inputs external wireless signals and a control circuit, the control circuit adapted to input the external wireless signals and program the memory cells with the identifier that is transmitted with the external wireless signals.

20. The apparatus according to claim 18 further including preprogrammed memory cells.

21. The apparatus according to claim 18 further including a hole disposed in the bullet, and the memory device is attached to the bullet by being located within the hole.

22. The apparatus according to claim 18 wherein the memory device includes an antenna.

23. An apparatus fired by a gun and capable of having an identifier associated therewith written to with a programming device and read therefrom with a reading device, the apparatus comprising:

a casing having an open end;

explosive material disposed within the casing;

a bullet having a front projectile end and another end that covers the open end of the casing;

a memory device attached to the bullet, the memory device having memory cells that are programmable and adapted to store in the memory cells the identifier; and a hole disposed in the bullet, wherein the memory device is attached to the bullet by being located within the hole, and further including a plug that assists in retaining the memory device, including unprogrammed memory cells that can be subsequently programmed after manufacture of the apparatus, within the hole.

24. The apparatus according to claim 23, wherein the memory device further includes a receiver that inputs external wireless signals and a control circuit, the control circuit adapted to input the external wireless signals and program the memory cells with the identifier that is transmitted with the external wireless signals.

25. The apparatus according to claim 23 further including preprogrammed memory cells.

26. The apparatus according to claim 25 wherein the preprogrammed memory cells are laser programmable memory cells.

27. The apparatus according to claim 23 wherein the memory device includes an antenna.

28. The apparatus according to claim 27, wherein the memory device further includes a receiver that inputs external wireless signals and a control circuit, the control circuit adapted to input the external wireless signals and program the memory cells with the identifier that is transmitted with the external wireless signals.

29. An apparatus fired by a gun and capable of having an identifier associated therewith written to with a programming device and read therefrom with a reading device, the apparatus comprising:

a casing having an open end;

explosive material disposed within the casing;

a bullet having a front projectile end and another end that covers the open end of the casing; and a memory device attached to the bullet, the memory device having memory cells that are programmable and adapted to store in the memory cells the identifier, wherein the memory device includes a control circuit that controls programming the memory cells.

30. The apparatus according to claim 29 further including a hole disposed in the bullet, and the memory device is attached to the bullet by being located within the hole.

31. The apparatus according to claim 29 further including preprogrammed memory cells.

32. The apparatus according to claim 31 wherein the preprogrammed memory cells are laser programmable memory cells.

33. The apparatus according to claim 29, wherein the memory device further includes a receiver that inputs external wireless signals and wherein the control circuit is adapted to input the external wireless signals and program the memory cells with the identifier that is transmitted with the external wireless signals.

34. The apparatus according to claim 33 further including a hole disposed in the bullet, and the memory device is attached to the bullet by being located within the hole.

35. The apparatus according to claim 34 further including preprogrammed memory cells.

36. The apparatus according to claim 35 wherein the memory device includes an antenna.

37. The apparatus according to claim 29 wherein the memory device includes an antenna.

* * * * *